United States Patent [19]

Vermeulen

[11] 4,242,815

[45] Jan. 6, 1981

[54] SUCTION PIPE POSITION CONTROL

[75] Inventor: Teunis Vermeulen, Papendrecht, Netherlands

[73] Assignee: Koninklijke Bos Kalis Westminster Group N.V., Netherlands

[21] Appl. No.: 898,536

[22] Filed: Apr. 21, 1978

[30] Foreign Application Priority Data

Apr. 28, 1977 [NL] Netherlands ..... 7704643

[51] Int. Cl.[3] ..... E02F 3/88

[52] U.S. Cl. ..... 37/58; 37/72; 37/195; 37/DIG. 1; 37/DIG. 19

[58] Field of Search ..... 37/58, 72, 195, DIG. 1, 37/DIG. 19

[56] References Cited

U.S. PATENT DOCUMENTS

| | | | |
|---|---|---|---|
| 2,534,917 | 12/1950 | King | 37/72 |
| 3,512,281 | 5/1970 | Hadjidakis | 37/72 X |
| 3,514,881 | 6/1970 | Hadjidakis | 37/58 |
| 3,589,040 | 6/1971 | DeKoning et al. | 37/58 |
| 3,624,932 | 12/1971 | Doyle | 37/55 |
| 3,645,018 | 2/1972 | DeKoning et al. | 37/58 |
| 3,734,564 | 5/1973 | McKay et al. | 37/69 X |
| 3,739,503 | 6/1973 | Barker et al. | 37/72 X |
| 4,108,499 | 8/1978 | Sandberg | 37/72 X |

FOREIGN PATENT DOCUMENTS

| | | | |
|---|---|---|---|
| 1933650 | 5/1970 | Fed. Rep. of Germany | 37/58 |

*Primary Examiner*—Clifford D. Crowder

*Attorney, Agent, or Firm*—Morse, Altman, Oates & Dacey

[57] ABSTRACT

Method and apparatus for controlling the position of the last section of a suction pipe with a drag head, wherein the suction pipe comprises at least two pivotally connected sections and wherein there are provided at least two independently operable hoisting winches for the suction pipe and wherein the hoisting installations are operated so that the last section of the suction pipe with drag head is kept at a specific, pre-determined angle of inclination.

8 Claims, 2 Drawing Figures

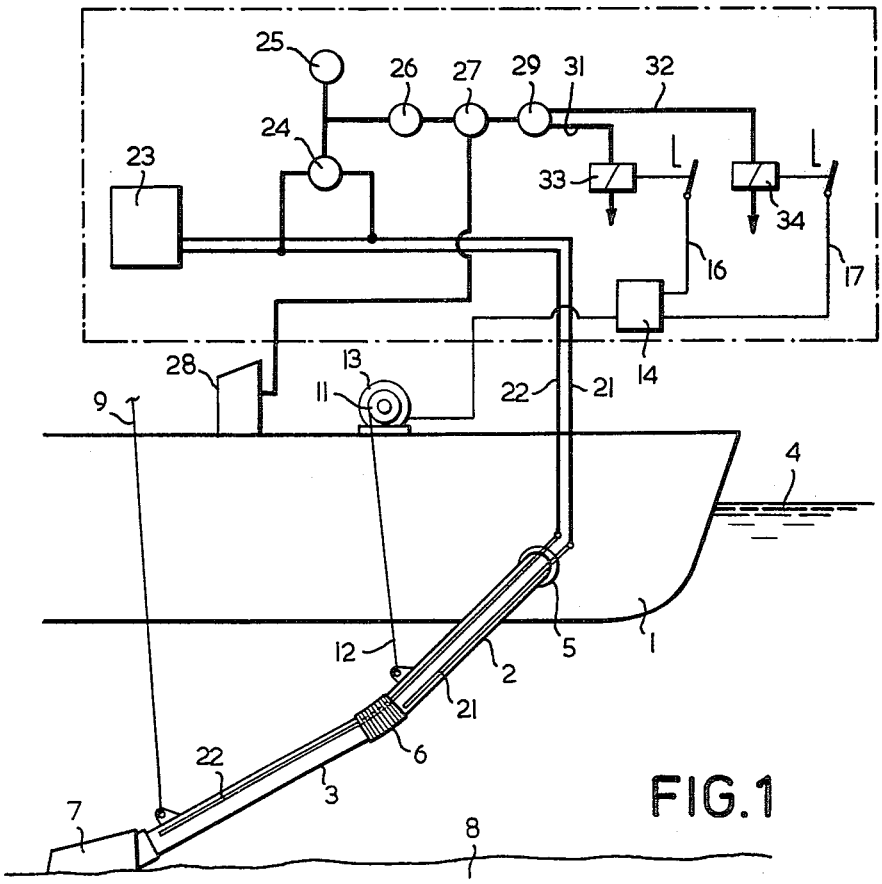
FIG.1
FIG.2
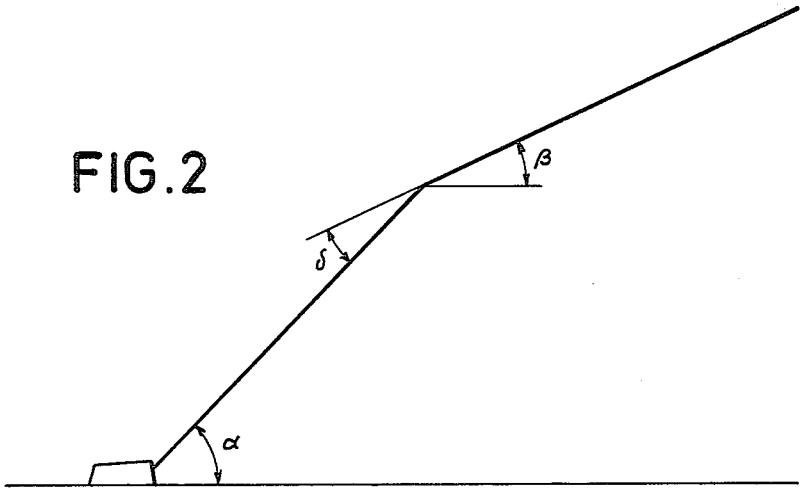

SUCTION PIPE POSITION CONTROL

SUMMARY OF THE INVENTION

The present invention relates to a method of controlling the position of a suction pipe with drag head, as well as to a device used therein.

A suction pipe on a dredger is mostly divided in a plurality of sections which are pivotally interconnected, whereby at the one end of the suction pipe there is disposed a drag head and the other end of the suction pipe being pivotally connected to the dredger. In order to adjust and maintain the proper position of the suction pipe, there is usually provided one or more suspension systems, e.g. gantries whereon suspension wires run to winches, the arrangement being such that the end of the suction pipe provided with the drag head is often connected via a swell compensator to the dredging vessel. In such a case there can be achieved, by adjusting the pressure of the swell compensator, a corresponding, substantially constant pressure of the drag head on the bottom.

It is the object of the invention to provide an improved method of controlling the proper position of the suction pipe with drag head as well as a device to be used therefor.

To this effect it is proposed according to the invention, to continuously determine the gradient of the last suction pipe section, whereon the drag head is disposed, thereby so operating the suspension systems that there is continuously maintained a pre-determined position of the last suction pipe section with drag head. As a result of the separate control of the position of the last section of the suction pipe with drag head there can always be realized an optimally exact position of the drag head relative to the bottom. The accurate control of the proper position is in particular of importance for a suction pipe provided with a visor head of which the visor is secured relative to the head, and for a suction pipe whose head is provided with blades or knives for loosening the soil. It is observed that in general a drag nozzle is provided with solid sole plates by means of which the drag head is moved over the soil. Normally, in case of a multi-section suction pipe, no special provisions are made for controlling the gradient of the last section of the suction pipe. It will be clear that in general when suction operations take place at greater depth, the suction pipe will occupy a steeper position. And vice versa, when suction operations are carried out at a lesser depth, the suction pipe will occupy a more flat position. According to the invention the variation of the suction depth is now preferably effected by varying the gradient of the at least one pipe section being present between the last pipe section with drag head and the dredging vessel. A variation of the suction depth is then compensated or achieved by the variation of the position of at least said one pipe section but thereby the gradient of the last pipe section with drag head is maintained. As a result, when it concerns a visor head with fixed visor and blade or an other head type rigidly connected to the last suction pipe section with blades, the blade will maintain the once adjusted position relative to the soil, so that the loosening of the soil, independently of the suction depth, can be carried out optimally. Insofar as a variation of soil composition or density thereof necessitates a different position of the blade and/or the drag head relative to the soil, a different inclination of the last section of the suction pipe with drag head can be adjusted.

For determining the position of the suction pipe, use may be made of a measurement of the suspension system on either side of the last suction pipe section. For instance, the length of both suspension wires may be compared. Use may also be made of a clinometer or so-called pendulum attached to the last suction pipe section. A very effective method is obtained, however, when the depth of the two ends of the last pipe section relative to the dredging vessel and/or the water surface is determined. This can be simply effected by using so-called "bubbling points", by means of which the pressure in situ is measured and the difference between said two pressures, possibly taking into account the specific weight of the water and making allowance for the length of the respective section of the suction pipe, gives the angle of inclination. Since the drag head which is fixedly connected to the end of the suction pipe, must be dragged over the bottom, a control of the position of the last suction pipe section can be easily carried out by operating the one but hindmost winch whereon the suction pipe is suspended, either by paying out or by taking in same.

The method according to the invention is in particular also suitable for automatic performance, wherein optimally the various relevant factors can be observed, such as the position of the visor or of the blades relative to the head, the type of soil, the shape of the blade, the pressure of the head on the soil, depending on the weight of the head and the force in the suspension wire, further secondary forces in situ of the head, such as influence of water flow, weight of the last pipe section, shape of the head and especially the size and the point of application of the resulting various forces.

Also the inclination of the last pipe section plays a role in connection with the direction of the pulling force. It is observed that the method and the apparatus can be simply completed by applying protection measures with respect to the outer positions and the minimum and maximum angle of inclination of the last suction pipe section.

BRIEF DESCRIPTION OF THE DRAWINGS

FIG. 1 shows diagrammatically a device according to the invention; and

FIG. 2 shows the various relevant angles.

DESCRIPTION OF THE PREFERRED EMBODIMENT

FIG. 1 of the drawing diagrammatically shows a trailing suction dredger 1 provided with a suction pipe comprising two pivotally interconnected sections 2 and 3.

The vessel 1 moves through the water, the water surface being indicated by 4. The top end or front end of the suction pipe is connected at 5 pivotally to the vessel. The pivot point between the two pipe sections is conventionally designed and indicated by 6. At the lower or rear end of the suction pipe there is disposed a drag head 7 which is fixedly connected to the last section of the suction pipe, but which may be adjustable. It is also possible to only make the blades adjustable relative to the head. The soil or bottom which is sucked up is indicated by 8. The suction pipe is suspended on a rear winch of which only the suspension wire 9 is shown. Furthermore a front winch 11 with wire 12 is indicated.

In practice mostly three or more suspension winches will be used. In case of three winches the central winch will be concerned and in case of more than three winches, the one but rearmost winch. The motor of said suspension winch 11, being drivable in both rotation directions, is indicated by 13 and is operated by means of a reversing switch 14. When the wire has to be taken in, a signal is received via line 16, while via line 17 the command "pay out" is given. The rearmost suspension wire 9 is conducted in a manner not shown via a swell compensator so that the drag head continues to rest on the bottom at the required, adjustable pressure, independently of the position of the centre pivot point 6. A possibly required variation of inclination of the last pipe section will be realized by taking in or paying out the front hoisting wire 12.

Along the suction pipe 2,3 there extends a front compressed air line 21 which debouches adjacent the pivot point 6, as well as a rear compressed air line 22 which debouches approximately adjacent the suction head. The pressure in said lines is determined by the depth at which the nozzles are located so that said pressure is a direct indication for the distance from the outflow openings to the water surface 4. For a known length of the last section 3 of the suction pipe a specific pressure difference corresponds with a specific inclination of this last pipe section. In a known manner, it is thus possible to indicate on indicator 23 the depth of the two measuring points of the last suction pipe section.

The two lines 21 and 22 are connected to a pressure difference transmitter 24. The pressure difference can be indicated on an indicator 25. Its signal is a measure for the inclination of the last pipe section. The signal of the pressure difference transmitter 24 is supplied to an input signal converter 26 where said signal is converted and applied to a regulator 27. Said regulator receives a second signal originating from a setting means 28. To said setting means, which is accommodated in the desk of the suction foreman, is set the required value for the pressure difference, possibly calibrated in sin $\alpha$ or $\alpha$, the angle of inclination of the last suction pipe section. Comparison of both signals in regulator 27 leads to a "yes" or "no" information in a comparator unit 29 which, via line 31, respectively 32, via switches 33, respectively 34, are used for the taking in or paying out movements of the winch and passed through via line 16, respectively 17 to the reversing switch 14 for the front rope winch motor 13.

Furthermore, use is also made of a switch, not shown, through which the front winch can be converted to hand operation. Such a hand operation is necessary at any rate when the suction pipe has to be pulled up.

The described regulator has only one controllable parameter, viz. the angle $\alpha$ of the lower section of the suction pipe (see FIG. 2). With a control program wherein exclusively this angle $\alpha$ is kept constant, there is the risk that the angle $\alpha$ between the lower and upper section of the suction pipe would become too large. For this purpose there may be provided a protection device that is responsive to the magnitude of the angle $\delta=\alpha-\beta\cdot\delta$ may be positive or negative. The value of $\beta$ is similarly measured as that of $\alpha$. In case specific adjustable values of $\delta$ are exceeded, an alarm is given and at the same time the automatic control of the front winch is blocked. Furthermore it is possible in a simple manner to apply also other alarm systems and blocking arrangements, e.g. if $\alpha$ is smaller than 0°; $\alpha$ larger than 45°; $\beta$ smaller than 0° and $\beta$ larger than 45°. The latter provisions also offer protection when one of the compressed air lines to the bubbling points either is broken or gets clogged, because also in such case the alarm system will come into operation, for then there is always produced such a measuring pressure that as a result the calculated value for the angle $\alpha$ and/or $\beta$ and/or $\delta$ will fall beyond the limits set.

I claim:

1. A method for the continuous and automatic control of the angle of inclination of the last section of a suction pipe provided with a drag head relative to the sea bottom of a trailing suction dredger having a suction pipe consisting of more than one section comprising the steps of (a) maintaining said drag head via a swell compensator in contact with the sea bottom at the required pressure, and (b) continuously and automatically controlling said angle of inclination of said last section of suction pipe relative to the sea bottom by varying the depth of the connecting point between said last section and the section immediately adjacent it.

2. A method for the continuous and automatic control of the angle of inclination of the last section of a suction pipe provided with a drag head relative to the sea bottom of a trailing suction dredger having a suction pipe consisting of more than one section comprising the steps of (a) maintaining said drag head via a swell compensator in contact with the sea bottom at the required pressure, (b) measuring the depths of the end points of the last and of the next to the last sections of said suction pipe and generating signals representative of said depths, (c) converting said signals into a signal representative of the angle of inclination of said last section of said suction pipe relative to the sea bottom, (d) generating a second signal indicative of the desired angle of inclination of said last section relative to the sea bottom, (e) comparing said converted signal and said second signal and generating a comparative signal thereof, and (f) continuously and automatically controlling said angle of inclination of said last section of suction pipe relative to the sea bottom by varying the depth of the connecting point between said last section and said next to the last section of said suction pipe responsive to said comparative signal.

3. A method for continuously controlling and displaying the angle of inclination of the last section of a suction pipe relative to the sea bottom of a trailing suction dredger having a suction pipe consisting of more than one section comprising the steps of (a) maintaining the trailing end of said last section via a swell compensator in contact with the sea bottom at the required pressure, (b) continuously measuring and displaying the depths of the end points and the last and of the next to last sections of said suction pipe and generating a first signal representative of the angle of inclination of said last section of said suction pipe, (c) continuously generating a second signal indicative of the desired angle of inclination for said last section relative to the sea bottom, (d) comparing said first signal and said second signal and generating a comparative signal for controlling an electric circuit designed reversably to drive a winch having connection to said connecting point, and (e) continuously varying the depth of the connecting point between said last section and said next to the last section of said suction pipe responsive to said comparative signal so as to maintain said angle of inclination corresponding to said desired angle of inclination for said last section relative to the sea bottom.

4. An apparatus for the continuous and automatic control of the angle of inclination of the last section of a suction pipe provided with a drag head relative to the sea bottom of a trailing suction dredger having a suction pipe consisting of more than one section comprising (a) means for measuring the depths of the end points of the last and of the next to the last sections of said suction pipe and generating signals representative of said depths;

(b) means for converting said signals into a signal representative of the angle of inclination of said last section of said suction pipe relative to the sea bottom;

(c) means for generating a second signal indicative of the desired angle of inclination of said last section relative to the sea bottom;

(d) means for receiving and comparing said converted signal and said second signal and generating a comparative signal thereof; and (e) means for varying the depth of the connecting point between said last and said next to the last section responsive to said comparative signal, continuously and automatically controlling thereby the angle of inclination of said last section relative to the sea bottom.

5. The apparatus for the continuous and automatic control of the angle of inclination of the last section of a suction pipe of claim 4 in which there is a further means for indicating the depths of the end points of the last and of the next to the last sections of said suction pipe.

6. The apparatus for the continuous and automatic control of the angle of inclination of the last section of a suction pipe of claim 4 in which there is a further display means continuously displaying the angle of inclination of said last section of said suction pipe.

7. The apparatus for the continuous and automatic control of the angle of inclination of the last section of a suction pipe of claim 4 in which said means for varying the depth of the connecting point responsive to said comparative signal comprises a pair of switches designed reversably to actuate a motor for driving a hoisting winch operatively connected to said connecting point between said last and said next to the last sections of said suction pipe.

8. The apparatus for the continuous and automatic control of the angle of inclination of the last section of a suction pipe of claim 4 which is further provided with a means to indicate an excess of angles either in the last section or in the next to the last section of said suction pipe relative to the sea bottom.

* * * * *